US010244811B2

(12) United States Patent
Xiong et al.

(10) Patent No.: US 10,244,811 B2
(45) Date of Patent: Apr. 2, 2019

(54) SUSPENSION LOCKING TAB

(71) Applicant: Honeywell International Inc., Morris Plains, NJ (US)

(72) Inventors: Jack Xiong, Cranston, RI (US); Joseph Rodrigues, Smithfield, RI (US); Oliver Li, Shanghai (CN); Jie Zhu, Shanghai (CN)

(73) Assignee: Honeywell International Inc., Morris Plains, NJ (US)

( * ) Notice: Subject to any disclaimer, the term of this patent is extended or adjusted under 35 U.S.C. 154(b) by 312 days.

(21) Appl. No.: 15/054,204

(22) Filed: Feb. 26, 2016

(65) Prior Publication Data

US 2017/0245578 A1 Aug. 31, 2017

(51) Int. Cl.
*A42B 3/14* (2006.01)
*A42B 3/08* (2006.01)

(52) U.S. Cl.
CPC ..... *A42B 3/147* (2013.01); *A42B 3/085* (2013.01); *A42B 3/14* (2013.01)

(58) Field of Classification Search
CPC ..... A42B 3/14; A42B 3/145; A42B 3/324
See application file for complete search history.

(56) References Cited

U.S. PATENT DOCUMENTS 2,359,387 A * 10/1944 Riddell ..... A42B 3/14 2/181
2,415,214 A 2/1947 Lewis
2,741,768 A * 4/1956 Ruggiero ..... A42B 3/14 2/182.5
2,781,517 A 2/1957 Fisher
2,816,290 A 12/1957 Boyer
2,858,538 A 11/1958 Simpson
2,866,977 A * 1/1959 Finken ..... A42B 3/14 2/416
2,923,942 A * 2/1960 Lee et al. ..... A42B 3/14 2/418
3,026,523 A 3/1962 Bowers, Sr. et al.
3,175,225 A 3/1965 Lindblom
3,388,405 A 6/1968 Simpson et al.
(Continued)

FOREIGN PATENT DOCUMENTS

JP 2002105736 A 4/2002
JP 2013091882 A 5/2013
WO 2015064968 A1 5/2015

*Primary Examiner* — Tajash D Patel
(74) *Attorney, Agent, or Firm* — Barlow, Josephs & Holmes, Ltd.

(57) ABSTRACT

A hardhat shell has a suspension that is secured to the shell by a hanger. The suspension has a horizontal band portion for extending around a user's head, and the suspension is positioned within a hardhat shell. At least one hanger is connected to the suspension for securing the suspension to the shell. Each hanger has a hook at a first end of the hanger, a latching surface located towards the middle of the hanger, and a lever arm at a second end of the hanger. At least one mount is formed on the inner surface of the shell. Each hanger is configured to securely engage a respective one of the mounts, with the latching surface of the respective hanger being in frictional engagement with the respective ledge surface of the mount. By manually pivoting the hanger, a user can cause the latching surface to disengage from the ledge surface.

15 Claims, 15 Drawing Sheets

(56) References Cited

U.S. PATENT DOCUMENTS

| | | | | |
|---|---|---|---|---|
| 3,555,560 | A * | 1/1971 | Rascke | A42B 3/14 2/416 |
| 3,797,039 | A | 3/1974 | Penberthy | |
| 5,113,534 | A * | 5/1992 | Lane | A42B 3/145 2/416 |
| 6,081,931 | A * | 7/2000 | Burns | A42B 3/14 2/411 |
| 6,609,254 | B2 * | 8/2003 | Bielefeld | A42B 3/14 2/416 |
| 6,817,039 | B1 * | 11/2004 | Grilliot | A42B 3/122 2/413 |
| 7,213,271 | B1 * | 5/2007 | Bielefeld | A42B 3/14 2/181 |
| 8,966,672 | B2 * | 3/2015 | Smith | A42B 3/04 2/416 |
| 2013/0232669 | A1 | 9/2013 | Smith | |
| 2015/0040295 | A1 | 2/2015 | Pfanner et al. | |

* cited by examiner

SUSPENSION LOCKING TAB

BACKGROUND

The present specification relates to a suspension for headgear of the type used in a head safety product such as a hardhat. More particularly, the specification is directed to a tab design for preventing a suspension from accidentally popping out of a hardhat.

SUMMARY

An improved suspension for headgear includes a suspension locking tab that allows a user to easily connect, disconnect, and reconnect a headgear suspension to a hardhat shell. The present disclosure provides a hardhat shell, a suspension, and a suspension locking tab (hanger), which can be provided to a user in various combinations. For example, a manufacturer can provide a user with a hardhat shell, a suspension, and at least one hanger for securing the suspension to the hardhat shell. Alternatively, a manufacturer can provide a user a hardhat shell and at least one hanger for securing a suspension that is provided separately, perhaps from a third party. Alternatively, a manufacturer can provide a user a suspension and at least one hanger for securing the suspension in a hardhat shell that is provided separately, perhaps from a third party.

The hardhat comprises a shell having an outer surface and an inner surface. A suspension is provided for supporting the shell on the head of a user.

The suspension includes a horizontal band that is configured to encircle a user's head, and the suspension further includes at least one arcuate portion that extends from the horizontal band to form a vertical cross-band configured to extend over a user's head.

At least one hanger is connected to the suspension for securing the suspension to the shell. Each hanger has a hook at a first end of the hanger, a latching surface located towards the middle of the hanger, and a lever arm at a second end of the hanger.

At least one mount is formed on the inner surface of the shell. Each mount has a mount platform toward a first end of the mount and a ledge surface at a second end of the mount. Each hanger is configured to securely engage a respective one of the mounts, with the latching surface of the respective hanger being in frictional engagement with the respective ledge surface of the mount and the mount platform being in direct facing relation with a surface on the hook, thereby positionally securing the hanger to the shell.

In use, the hanger is very easy to disengage from the hardhat shell, and is very easy to engage with the hardhat shell to secure the suspension to the hardhat. The user does not need to use a screwdriver to deform the hanger to disengage the hanger from the hardhat shell. The user simply pivots the hanger with respect to the hardhat shell, and then slides the hanger off of the mount.

To pivot the hanger with respect to the hardhat shell, the user simply puts his/her finger behind the hanger, between the hanger and the inner surface of the shell, and the user tilts the hanger with a force directed inwardly, away from the inner surface of the shell. The hanger smoothly disengages from the mount on the shell. A user can accomplish this disengagement of a hook from the shell with one hand, and even with delicate fingers. During the pivoting, there is a small deformation of the hanger, but the hanger is not permanently deformed to an extent that it cannot be secured to the shell again.

The hanger secures the suspension to the shell, and the hanger will stay secured to the shell, even during an impact load applied to the shell.

Because of the pivoting engagement of each hanger on a respective mount formed on the inner surface of the shell, the exterior surface of the shell can be uniformly convex. There is no need to have pockets formed on the inner surface of the shell, which would correspond to protrusions formed on the outer surface of the shell.

Each mount formed on the inner surface of the shell has a geometry that is not conducive to depositing of dust and dirt on the mount. A user can easily clean the corner surfaces of the mount when dust and dirt are present on the mount.

Accordingly, an objective is to provide a hanger for easily securing a suspension to a hardhat and for easily removing the suspension from the hardhat.

Another objective is to provide a suspension that is easy to remove from a hardhat and to assemble onto a hardhat.

Another objective is to provide a suspension that does not accidentally pop out from a hardhat.

Yet another objective is to provide a spring-biased preload on the tab to push the headband to fit the head of a user, thereby increasing comfort and fit for users.

Still another objective is to provide a suspension that allows the exterior of a hardhat shell to be formed without a bump, thereby increasing the aesthetic appearance of the exterior the hardhat shell, and thereby making the exterior of the hardhat shell easier to clean.

Other objects, features and advantages shall become apparent as the description thereof proceeds when considered in connection with the accompanying illustrative drawings.

BRIEF DESCRIPTION OF THE DRAWING FIGURES

An exemplary embodiment will now be described further by way of example with reference to the following examples and figures, which are intended to be illustrative only and in no way limiting upon the scope of the disclosure.

DETAILED DESCRIPTION OF THE EXEMPLARY EMBODIMENT

Generally, a hardhat employing a suspension locking tab as illustrated and described herein is useful for securing a suspension to a hardhat shell. One embodiment of the present disclosure includes a shell, a suspension for supporting the shell on a user's head, and at least one suspension locking tab (hanger) for securing the suspension to the shell.

Referring to FIGS. 1-15, the exemplary embodiment of the present disclosure is incorporated into a hardhat product indicated at 10. While the exemplary embodiment is illustrated in conjunction with a hardhat product, it should also be understood that the present locking tab (hanger) is contemplated for use in other head safety products.

Figure 1:
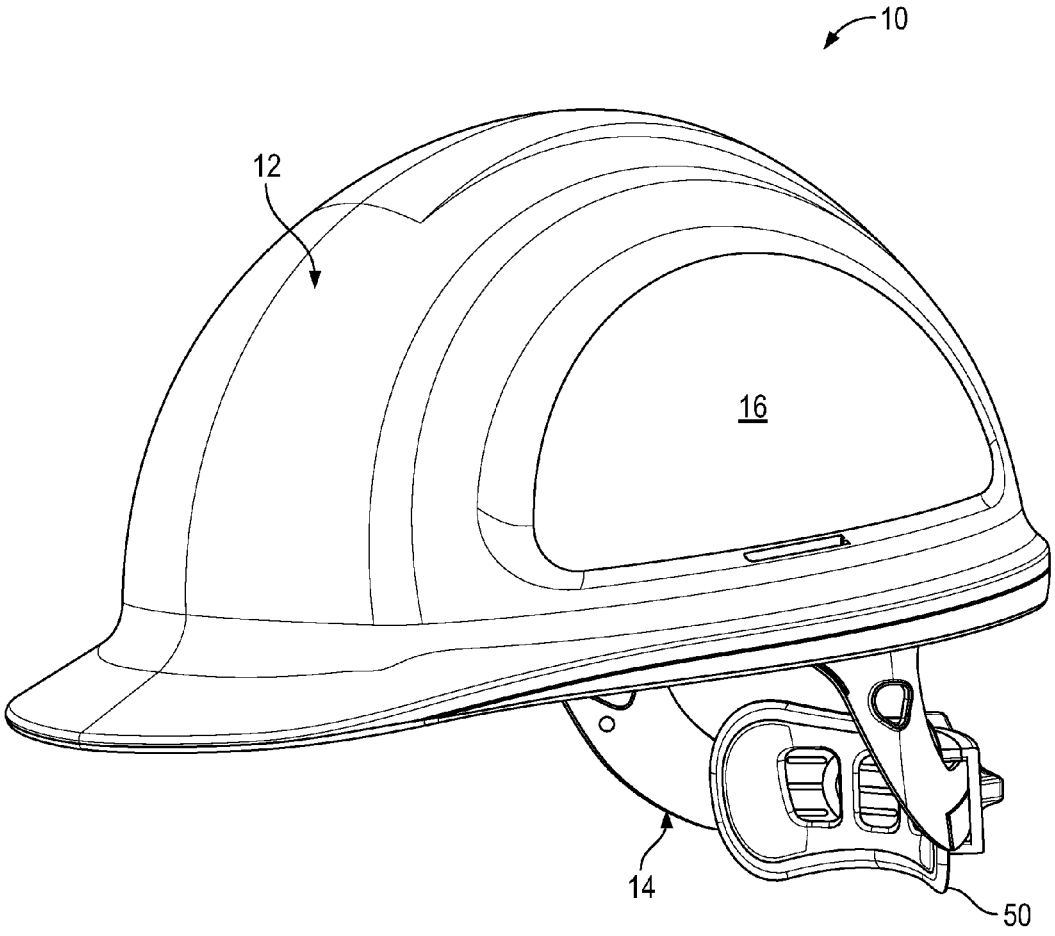
FIG. 1 is a perspective view of a hardhat with a suspension secured to the hardhat according to an exemplary embodiment of the present disclosure.
Figure 2:
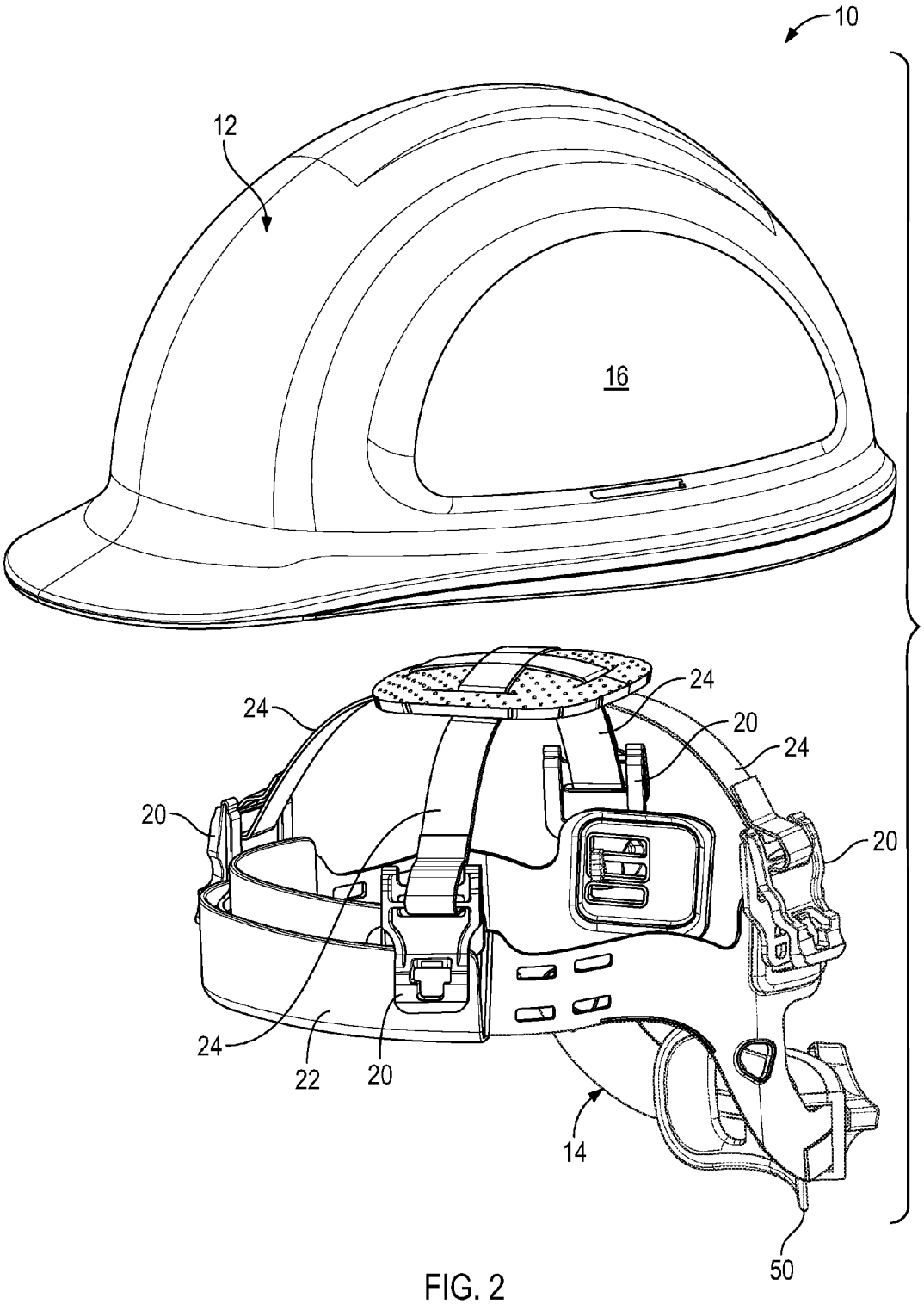
FIG. 2 is an exploded view thereof.
Figure 3:
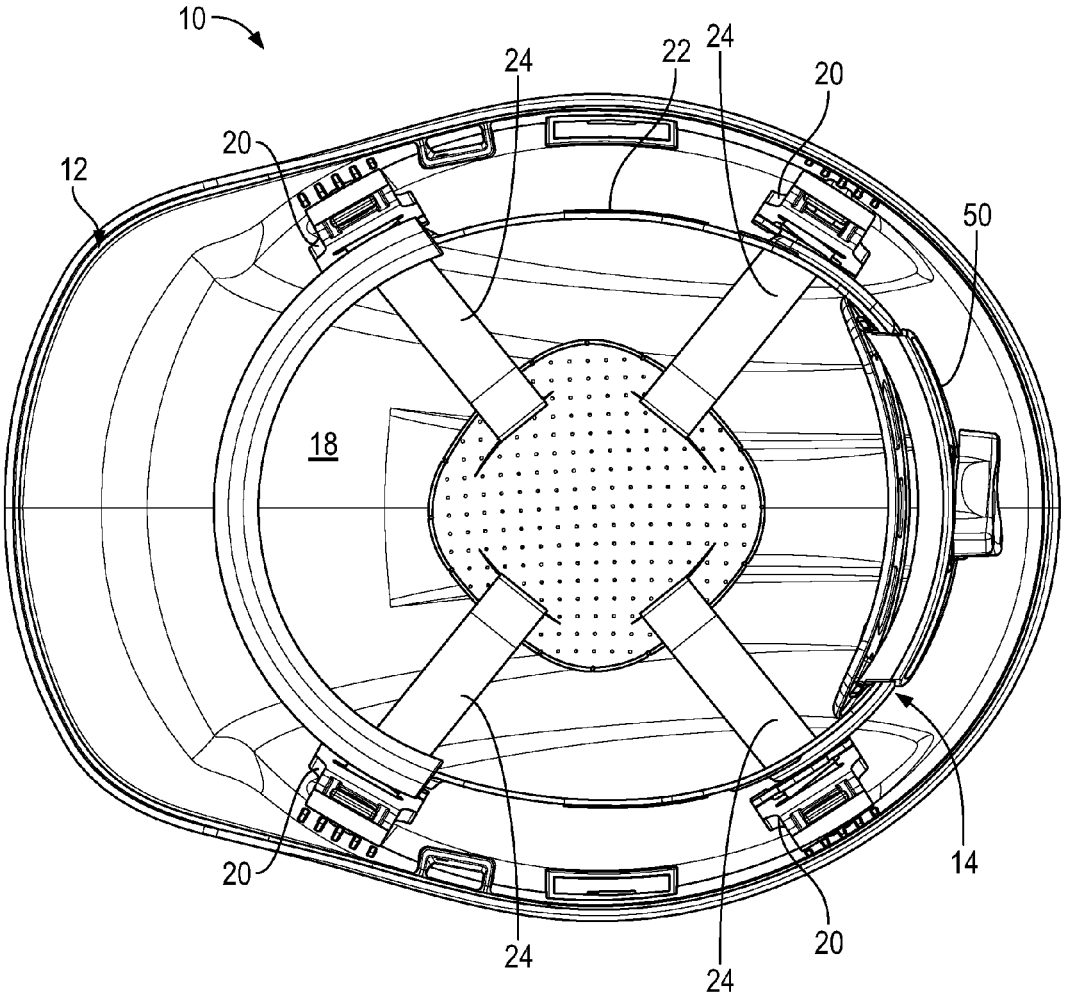
FIG. 3 is a lower view of a hardhat with a suspension secured to the hardhat according to an exemplary embodiment of the present disclosure.

FIGS. 1-3 show a hardhat 10 comprising a shell 12, which has an outer surface 16 and an inner surface 18. A suspension 14 is positioned within the cavity bounded by the inner surface 18 of the shell 12. The suspension 14 is supported on the shell 12 by at least one hanger 20. In the embodiment shown, there are four hangers 20 that secure the suspension 14 to the shell 12. FIG. 2 provides an exploded view of the embodiment of FIGS. 1-3.

The suspension 14 has a horizontal band 22 that is configured to encircle a user's head. The suspension 14 further has at least one arcuate portion 24 that extends from the horizontal band 22 to form a vertical cross-band configured to extend over a user's head.

Figure 4:
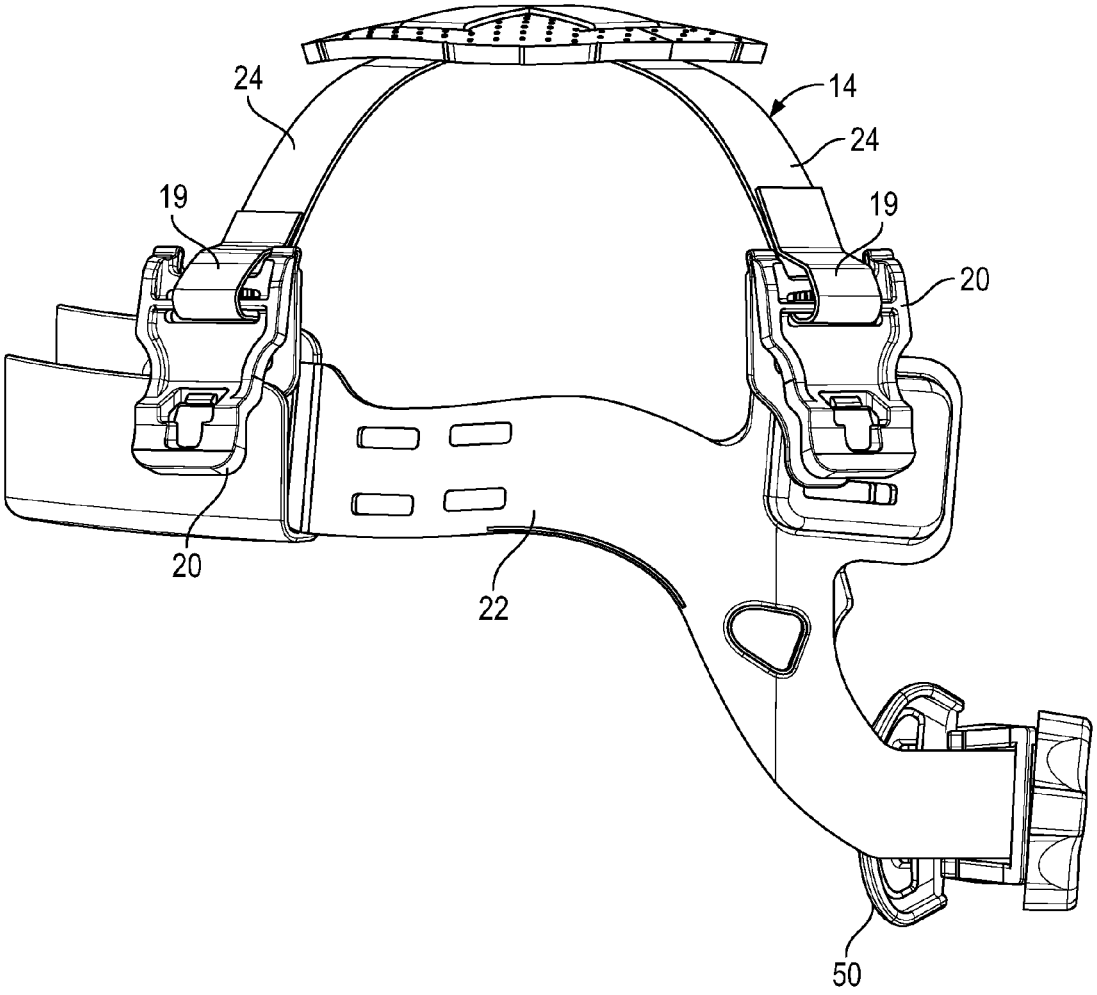
FIG. 4 is a perspective view of a suspension configured to be secured to a hardhat according to an embodiment of the present disclosure.

FIG. 4 shows a section of the suspension 14 with hangers 20 secured to the suspension, without a hardhat shell 12. A manufacturer may provide the suspension 14 and hangers 20 of FIG. 4 where a user already has a hardhat shell or where the shell is provided by a third party. The horizontal band 22 is not configured to entirely encircle the user's head when worn. An occipital support section 50 extends from the horizontal band 22 so that the occipital support section 50 is configured to engage the occipital region of a user's head when the suspension 14 is placed on a user's head.

Figure 5:
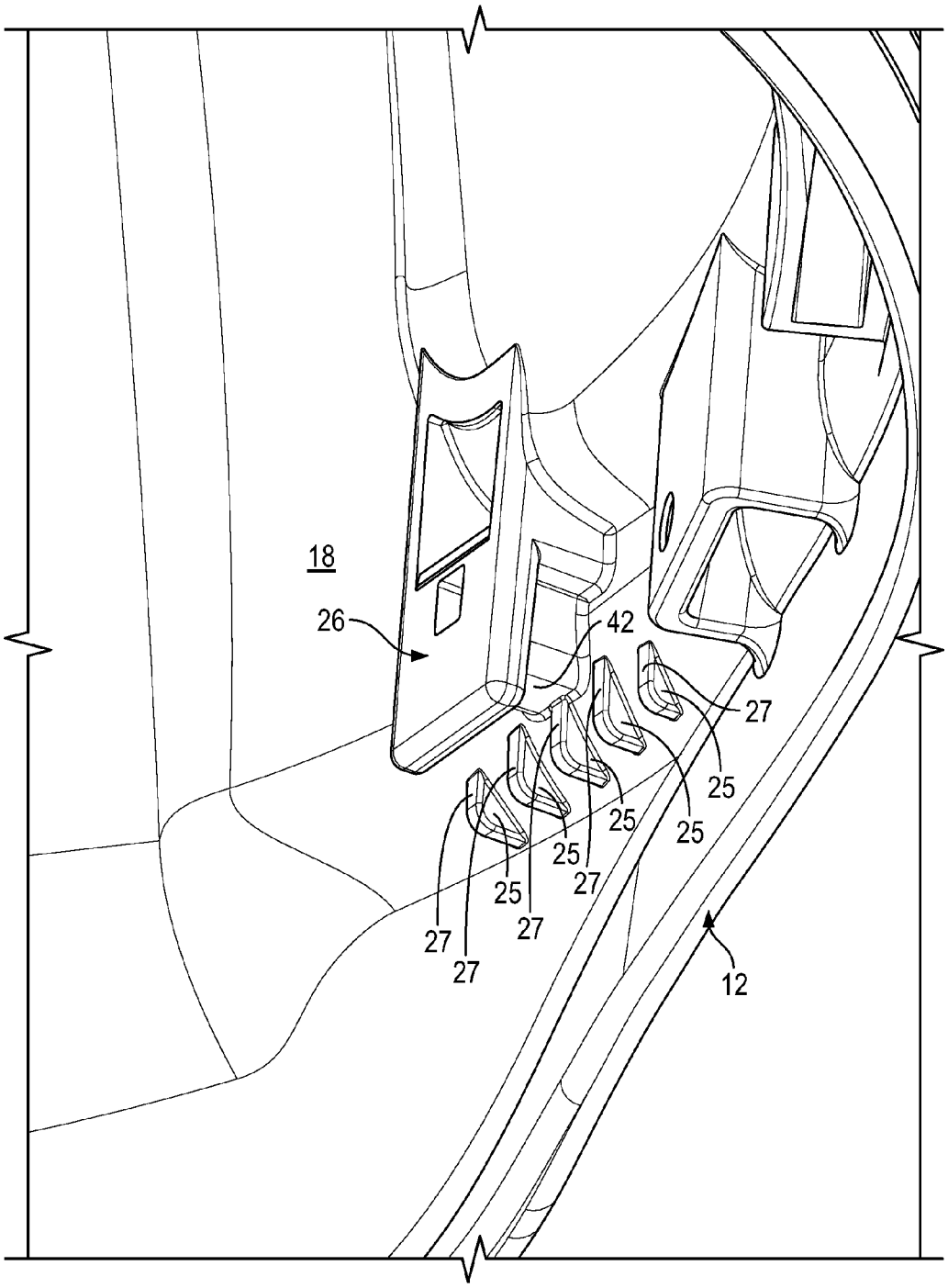
FIG. 5 is a perspective view of a mount for supporting a hanger.

FIG. 5 shows an enlarged perspective view of one of the mounts 26 for engaging a hanger 20. Each mount 26 has a geometry that inhibits the deposition of dust and dirt on the surfaces of the mount 26, and that is easy to clean. The mount 26 is configured so that when a hanger 20 engages the respective mount 26, the hanger 20 extends around the mount 26, rather than being received within a cavity defined by the mount.

Each mount 26 extends inwardly from a concave portion of the inner surface 18 of the shell 12. Because the hanger 20 engages this inwardly extending mount 26, the outer surface 16 of the shell 12 does not need to transition from a convex geometry to a concave geometry in a respective region of the outer surface adjacent to the respective second end of each mount. For example, the outer surface 16 of the shell does not need to have a geometry that is partially formed as a rectangular solid to accommodate a substantially rectangular pocket on the inner surface 18 of the shell 12, because the mount 26 extends outwardly from the inner surface 18.

For each mount 26, there is at least one triangular tab 25 that is provided on the inner surface 18 of the shell 12. The at least one triangular tab 25 is adjacent to the respective mount 26. In the embodiment shown in FIG. 5, there are five triangular tabs 25 extending inwardly from the inner surface 18 of the shell 12. The function of the triangular tabs 25 during insertion and removal of the hanger 20 is discussed in more detail below.

Figure 6:
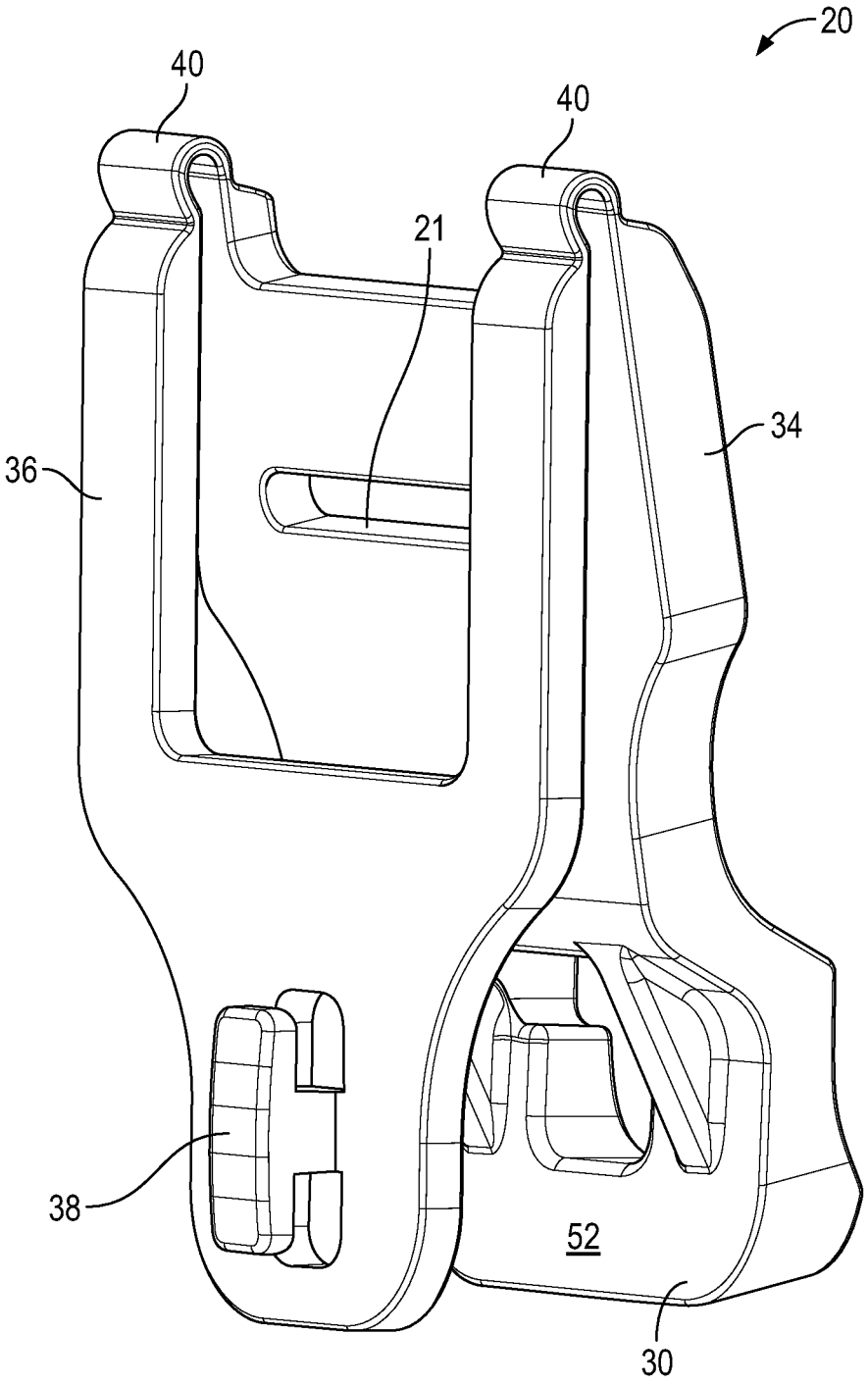
FIG. 6 is a perspective view of a hanger according to the present invention.
Figure 7:
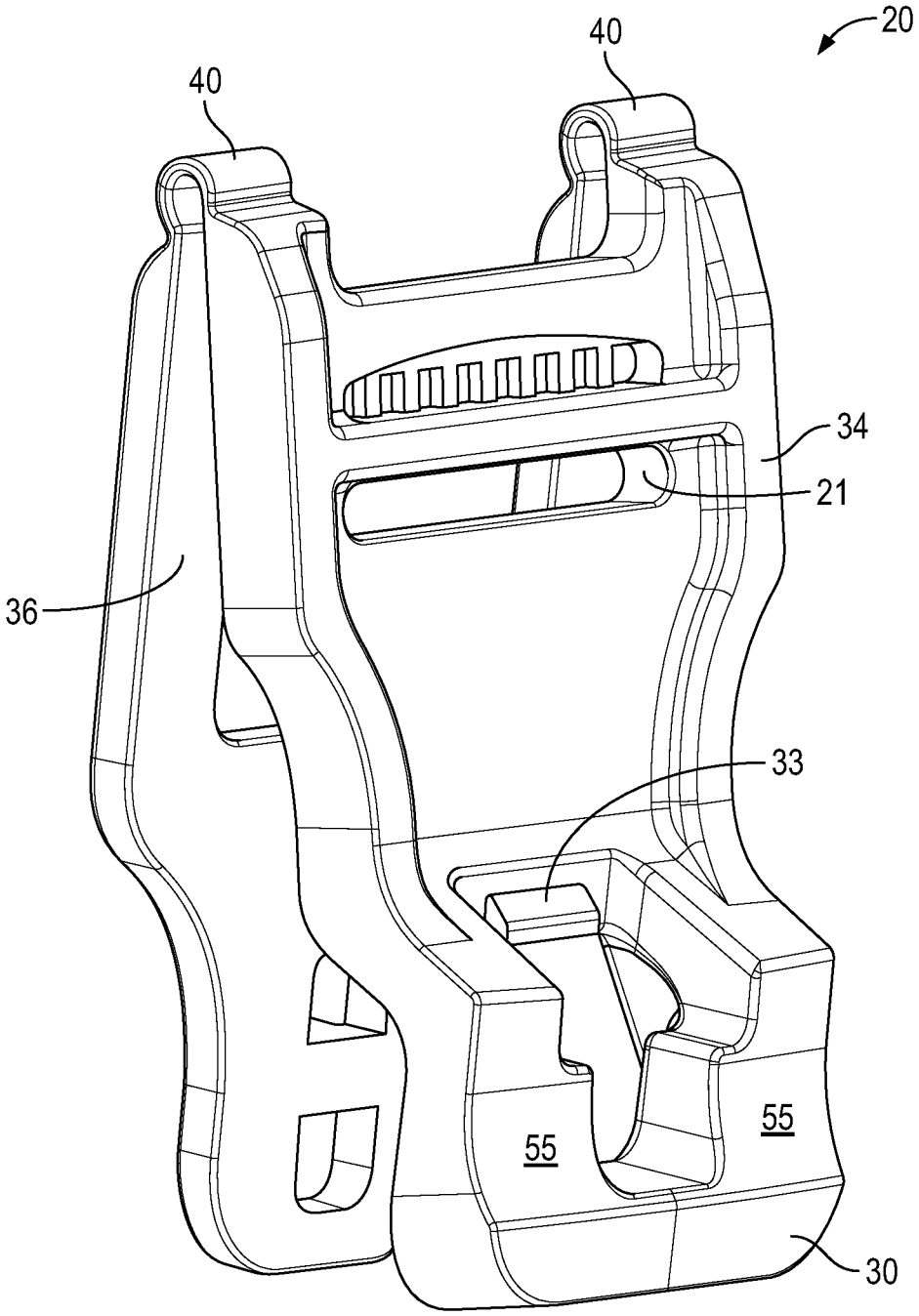
FIG. 7 is another perspective view thereof.
Figure 8:
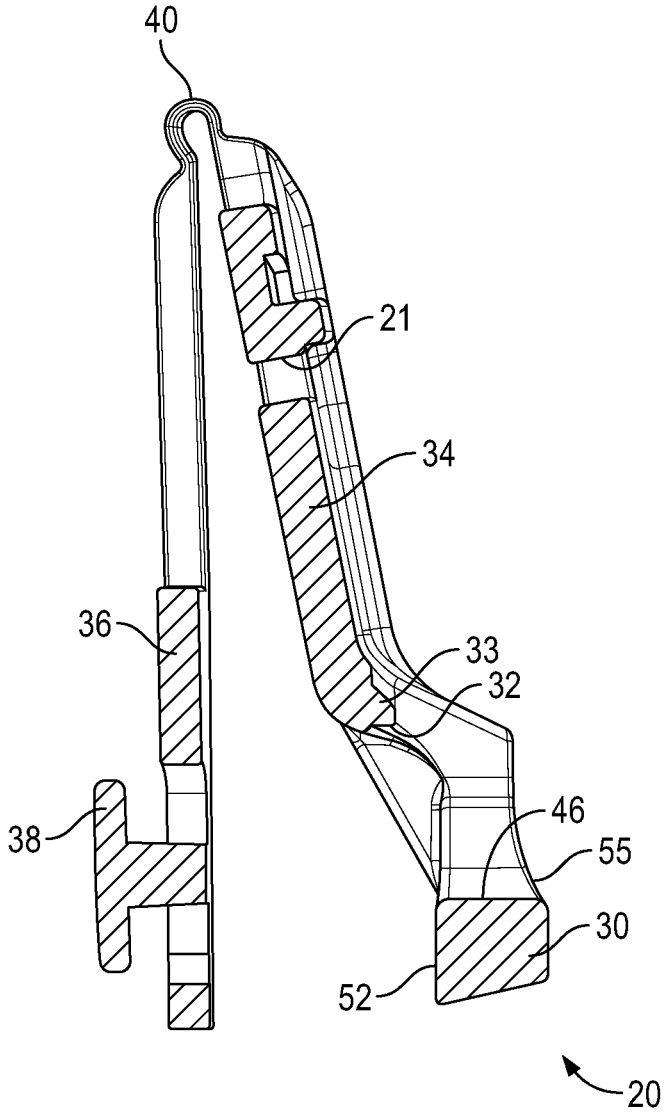
FIG. 8 is a cross sectional view thereof.

FIGS. 6 and 7 show perspective views of a hanger 20 before it has been secured to a suspension 14, and before it has been secured to a shell 12. FIG. 8 shows a cross sectional view thereof.

In the exemplary embodiment, the respective first end of each hanger 20 is a lower end of the respective hanger when the suspension 14 is secured to the shell 12 and the shell 12 is in an upright position, such as when the shell 12 is being worn on a user's head and the user is standing upright.

Each of the hangers 20 is capable of being connected to the suspension 14 for securing the suspension 14 to the shell 12. Each hanger 20 further has a hook 30 at a first end of the hanger 20, a latching surface 32 located towards the middle of the hanger 20, and a lever arm 34 at a second end of the hanger 20.

Each hanger 20 has a support arm 36 having a free portion for connecting the hanger 20 to the suspension 14. This free portion is a suspension support structure 38 that extends from the support arm 36. This suspension support structure 38 can be received in an aperture defined on the suspension 14. The support arm 36 is connected to the lever arm 34 by a pair of torsional springs 40. The support arm 36 may be pivoted with respect to the lever arm 34 about the springs 40, when the spring force is overcome. When the hanger 20 secures the suspension 14 to the shell 12, the hook 30 of the hanger 20 is in firmly fixed spatial relation with respect to the shell 12, while the support arm 36 is a free portion that can be pivoted with respect to the lever arm 34, and thus, with respect to the shell 12, when the spring force is overcome. This allows the suspension 14 to be comfortably secured to a user's head when the suspension 14 is secured to the shell 12 by one or more hangers 20.

Each hanger 20 has a loop aperture defined by a loop aperture wall 21. The loop aperture 21 encircles the loop aperture, and is useful for securing a loop 19 located at an end of an arcuate portion 24 of the suspension 14. This is shown, for example, in FIGS. 6-8.

Figure 9:
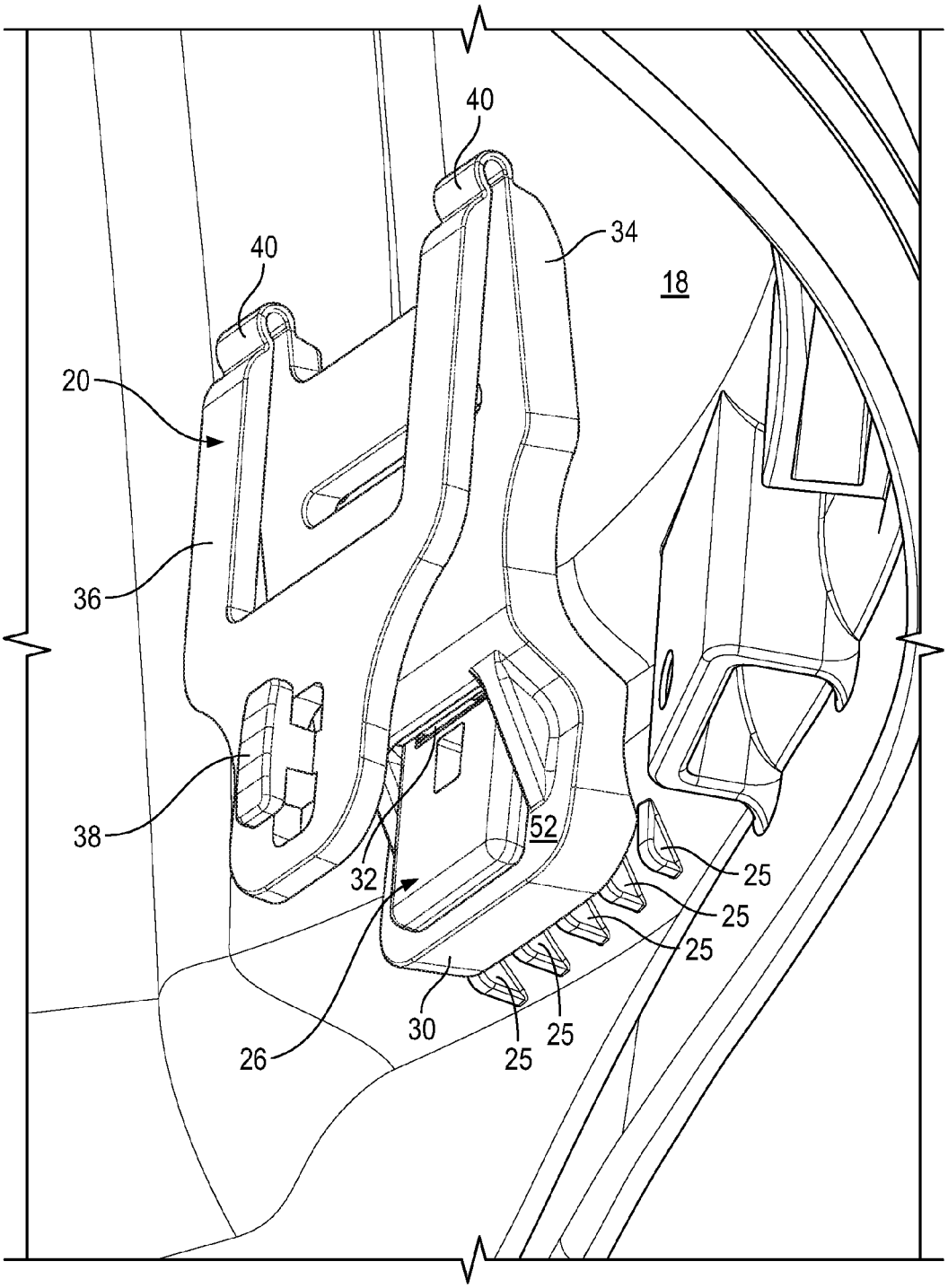
FIG. 9 is a perspective view of a hanger secured to a mount.

FIG. 9 shows an enlarged perspective view of one of the hangers 20 secured to a respective mount 26 of a hardhat shell 12. Such hardhat shell 12 may be provided to a user with a set of hangers 20 according to the present disclosure, such as the hangers 20 of FIG. 6. For example, a manufacturer may provide a shell 12 and a set of hangers 20 to a user separately from a suspension 14, which could be provided by a third party.

As with the external surface 16 of the hardhat shell 12 of FIG. 1, the hardhat shell 12 of FIG. 9 does not have a bump out or pocket feature on the external surface 16 at a location corresponding to the location of the mounts 26 on the internal surface 18. Such bump outs or pockets on the external surface 16 would impair industrial design and cleanability of the shell 12.

Figure 10:
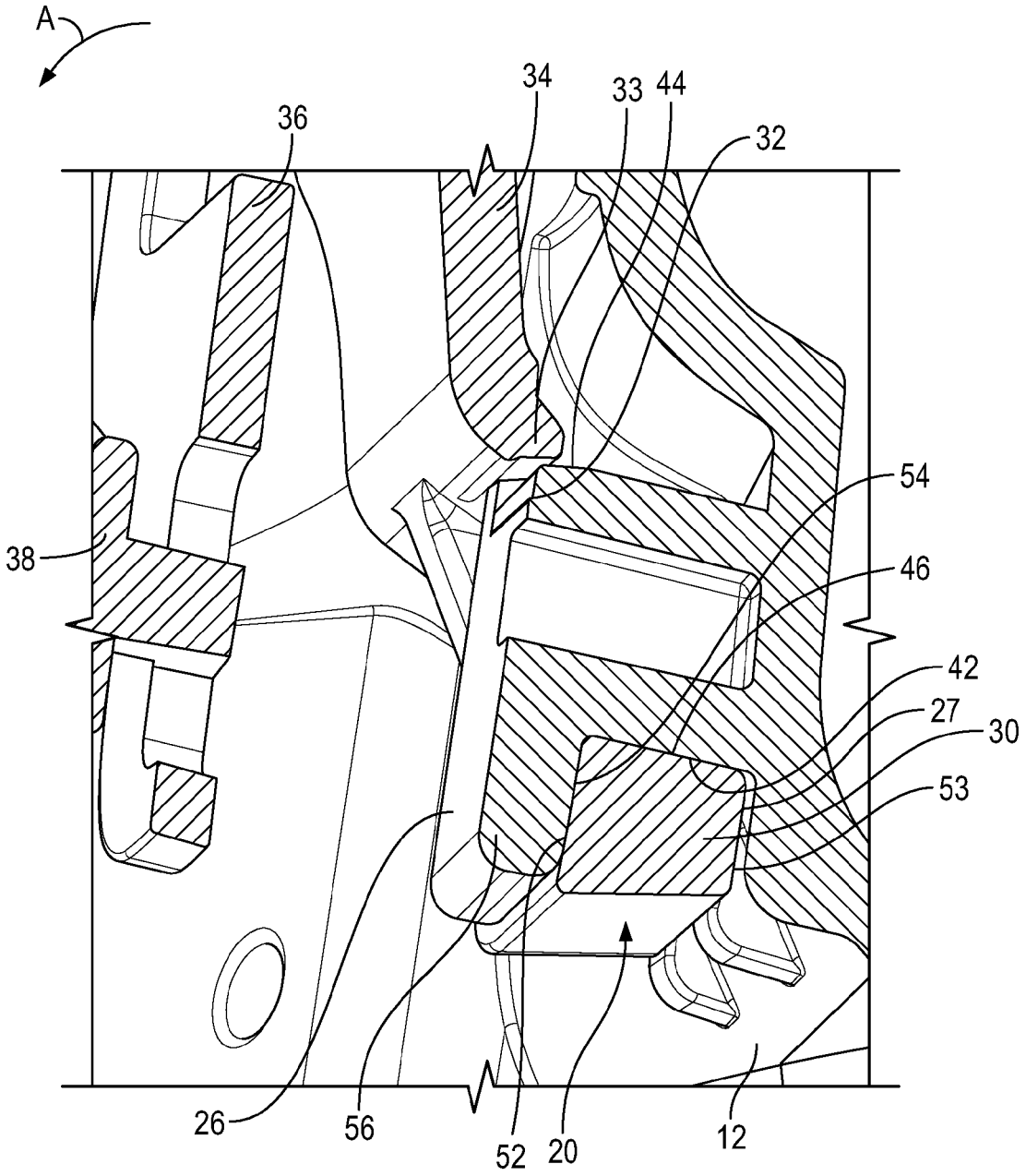
FIG. 10 is a sectional view thereof.
Figure 11:
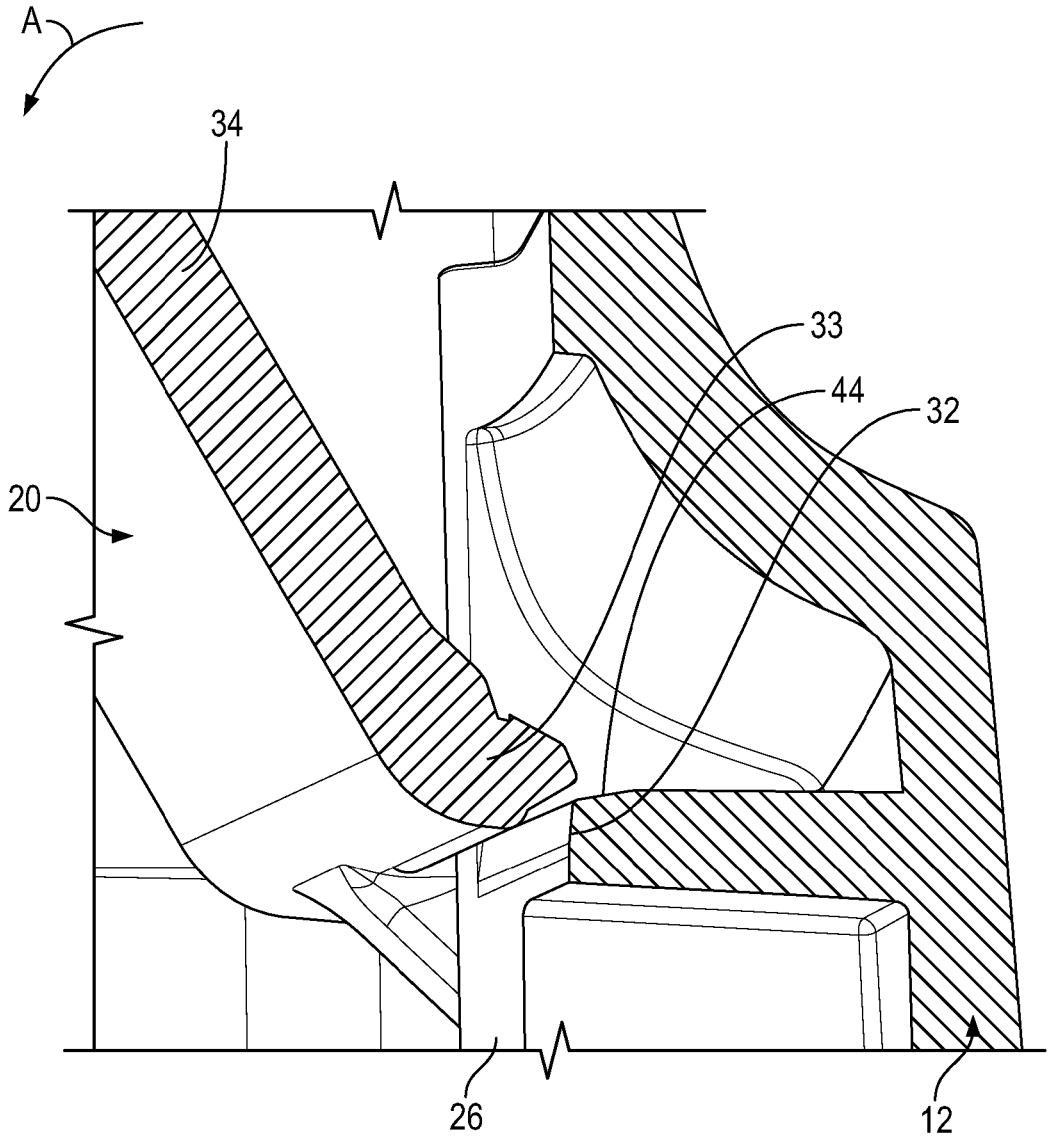
FIG. 11 is another view thereof, with the hanger pivoted with respect to the shell.
Figure 12:
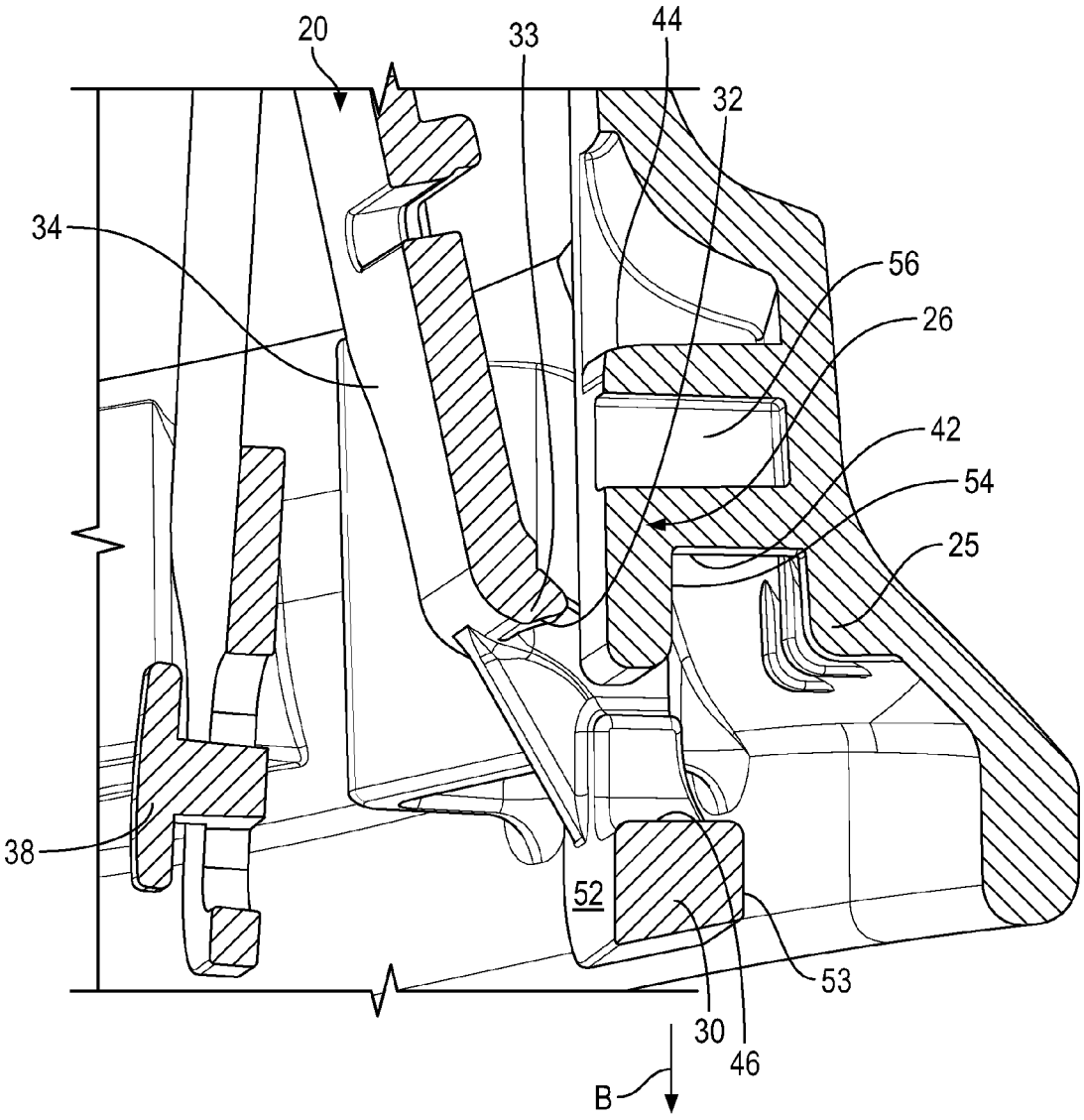
FIG. 12 is another view thereof showing removal of the hanger after the step of FIG. 11.

The engagement of the hanger 20 with the mount 26 is further shown in FIGS. 10-12.

FIG. 10 shows a sectional view of how each hanger 20 is secured to the hardhat shell 12. Each hanger 20 engages a respective mount 26 that is formed on the inner surface 18 of the shell 12. Each mount 26 has a mount platform 42 toward a first end of the mount and a ledge surface 44 at a second end of the mount 26.

Each hanger 20 is configured to securely engage a respective one of the mounts 26, with the latching surface 32 of the respective hanger 20 being in frictional engagement with the respective ledge surface 44 of the mount and the mount platform 42 being in direct facing relation with a surface 46 on the hook 30, thereby positionally securing the hanger 20 to the shell 12.

Each respective latching surface 32 is formed on a respective latching body 33 that extends radially outwardly from the respective hanger 20 when the suspension 14 is secured within a hardhat shell 12, and a user can disengage the latching surface 32 from the respective ledge surface 44 by deflecting the second end of the hanger radially inwardly, that is, by pivoting the lever arm 34 with respect to the mount 26.

For each respective hanger 20 and mount 26, the ledge surface 44 faces upwardly, and the latching surface 32 faces downwardly when the suspension 14 is secured to the shell 12 and the shell is in an upright position, such as when the shell 12 is positioned over a user's head and the user is standing upright.

FIG. 10 shows that the hanger 20 is fixed firmly on the mount 26 by the snap feature of the latching surface 32. Because of this firm engagement between the hanger 20 and the mount 26, the hanger 20 does not accidentally disengage the mount 26. The hanger 20 has an increased tendency to remain engaged to the shell 12 even when the shell 12 is subjected to an external impact load.

The firm fixation of the hanger 20 on the mount 26 is further enhanced by the engagement of a side face 52 of the hook 30 of the hanger 20 with a wall surface 54 of a wall portion 56 of the mount 26.

FIGS. 11 and 12 show cross sectional views of steps of disengaging a hanger 20 from a mount 26 on the shell 12. First, the user pivots the lever arm 34 of the hanger 20 along the arrow A (about the support surfaces 27 of the triangular tabs 25, as discussed below) so that the latching surface 32 disengages the ledge surface 44 of the mount 26 in FIG. 11. The hanger 20 slightly deforms to allow the latching surface 32 to laterally clear the ledge surface 44.

Then, the user slides the hanger 20 vertically downward along the arrow B in FIG. 12.

Figure 13:
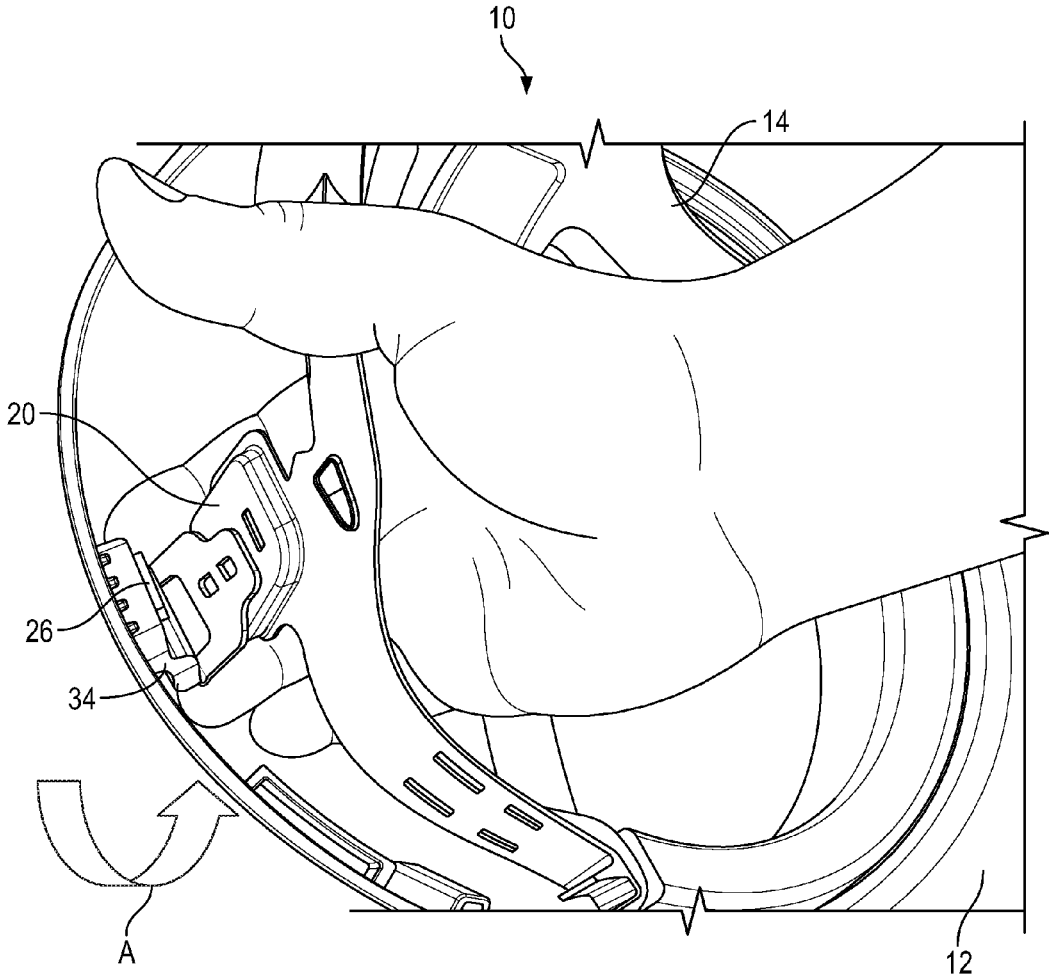
FIG. 13 is a perspective view of a user disengaging the hanger from the shell.
Figure 14:
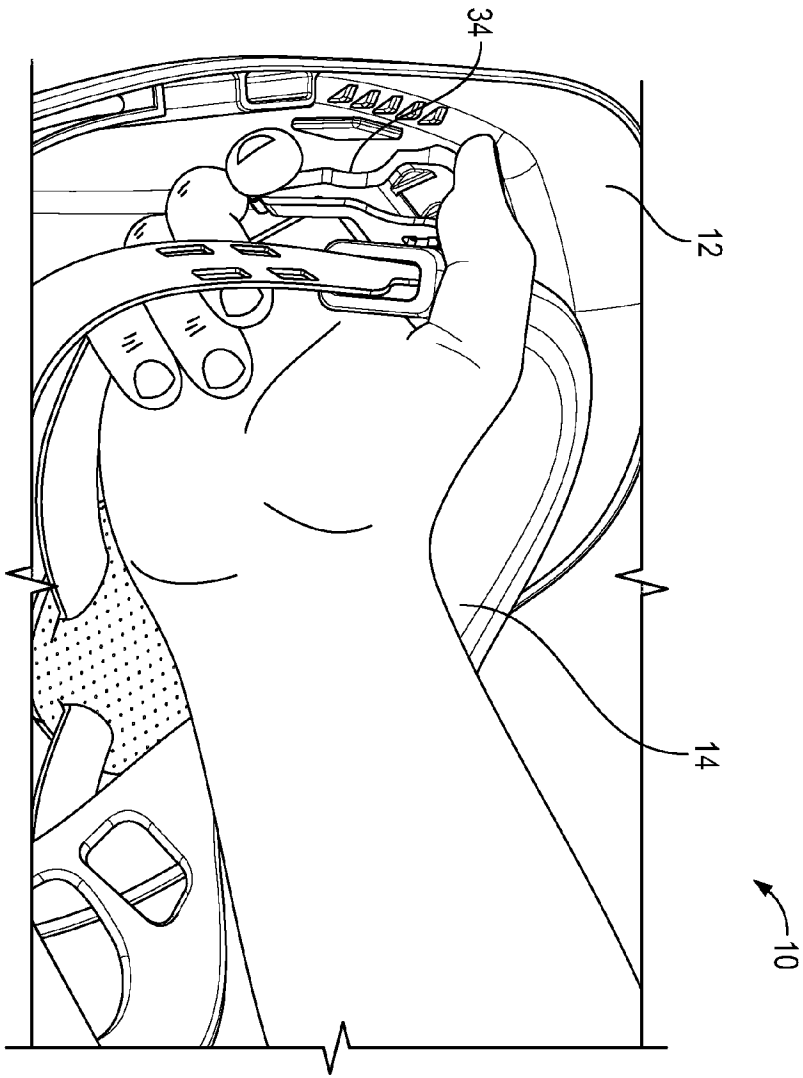
FIG. 14 is another view thereof.

FIGS. 13 and 14 show perspective views of a user disengaging a hanger 20 from a mount 26 on the shell 12. Each hanger 20 is easily removed by hand by pivoting the lever arm 34 along the arrow A. The manual removal of the hanger 20 from the shell 12 requires little manual strength, and can be performed with one hand. There is a small deformation to the hanger 20, but the hanger 20 is not permanently deformed, and a user can subsequently engage the respective hanger 20 with a mount 26 on the shell.

Figure 15:
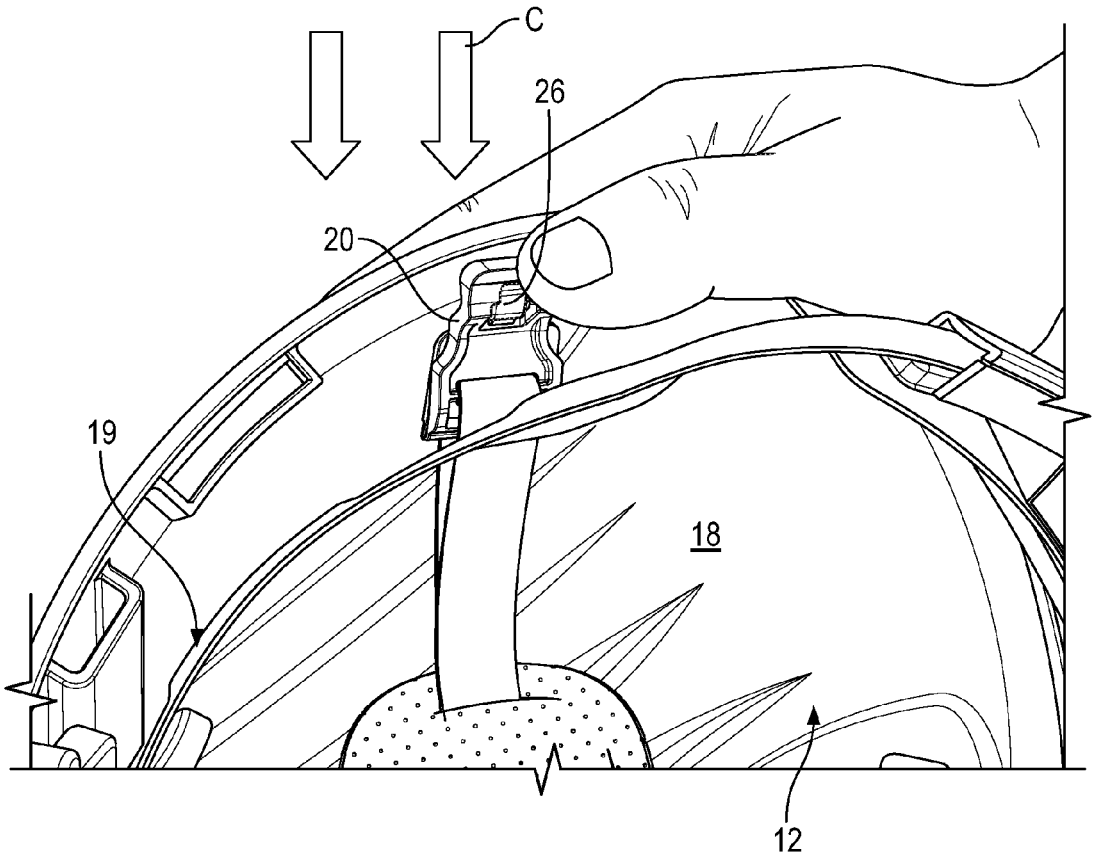
FIG. 15 is a perspective view of a user engaging the hanger with the shell.

To engage a hanger 20 with a mount 26 on the shell 12, FIG. 15 shows that a user simply slides the hanger 20 vertically downward onto the mount 26 along the arrow C when the shell 12 is inverted as shown in FIG. 15.

When the hanger 20 is secured on the mount 26, the triangular tabs 25 help to hold the hanger 20 in place. These triangular tabs 25 are useful both during latching the hanger to the shell and during unlatching the hanger 20 from the shell 12. When a user snaps the hanger 20 in place onto the mount 26, ramped surfaces 55 on the hanger 20 engage the support surfaces 27 of the triangular tabs 25, so the triangular tabs 25 push the hanger 20 body inward to guide it in place. When a user unlatches the hanger 20 from the mount 26, the support surfaces 27 on the triangular tabs 25 provide a fulcrum point for the hanger 20, to prevent outward movement of the hook 30 as the user pulls the spring 40 end of the hanger 20 inwardly. As the user pulls the spring 40 end of the hanger 20 inwardly, the outer surface 53 of the hook 30 end of the hanger 20 engages the triangular tabs 25, and the hanger 20 deforms so that the latching surface 32 disengages from the ledge surface 44.

Although the discussion relates to an embodiment in which there are four hangers 20 and four respective mounts 26 spaced about the inner surface 18 of the shell 12, other embodiments may have a different number of hangers 20, and thus a different number of mounts 26 so there is a hanger 20 corresponding to each mount 26.

Accordingly, among the objectives of the improved suspension are to provide a hanger for easily securing a suspension to a hardhat and for easily removing the suspension from the hardhat; to provide a suspension that is easy to remove from a hardhat and to assemble onto a hardhat; to provide a suspension that does not accidentally pop out from a hardhat; to provide a spring-biased pre-load on the tab to push the headband to fit the head of a user, thereby increasing comfort and fit for users; and to provide a suspension that allows the exterior of a hardhat shell to be formed without a bump, thereby increasing the aesthetic appearance of the exterior the hardhat shell, and thereby making the exterior of the hardhat shell easier to clean.

For these reasons, the present suspension and locking tab are believed to represent significant advancements in the art, which have substantial commercial merit.

While there is shown and described herein certain specific structure embodying the suspension and locking tab, it will be manifest to those skilled in the art that various modifications and rearrangements of the parts may be made without departing from the spirit and scope of the underlying concept and that the same is not limited to the particular forms herein shown and described except insofar as indicated by the scope of the appended claim.

What is claimed is:

1. A hardhat comprising:

a shell having an outer surface and an inner surface;

a suspension comprising a horizontal band that is configured to at least partially encircle a user's head;

a hanger connected to the suspension for securing the suspension to the shell, the hanger further comprising:

a hook at a first lower end of the hanger;

a latching surface located towards a middle of the hanger;

a lever arm at a second upper end of the hanger;

a mount formed on the inner surface of the shell, the mount having a mount platform toward a first lower end of the mount and a ledge surface at a second upper end of the mount;

wherein the hanger is configured to securely engage the mount with the latching surface of the hanger being in frictional engagement with the ledge surface of the mount and the mount platform being in direct facing relation with a surface on the hook, thereby positionally securing the hanger to the shell, and further wherein the first lower end of the hanger is the lower end thereof when the suspension is secured to the shell and the shell is in an upright position.

2. The hardhat of claim 1, the hanger further comprising a support arm having a free portion for connecting the hanger to the suspension, the support arm being connected to the lever arm by a spring.

3. The hardhat of claim 1, wherein the latching surface is formed on a latching body that extends radially outwardly from the hanger when the suspension is secured within a hardhat, and a user can disengage the latching surface from the ledge surface by deflecting the second upper end of the hanger radially inwardly.

4. The hardhat of claim 1, wherein the ledge surface of the mount faces upwardly, and the latching surface of the hanger faces downwardly.

5. The hardhat of claim 1 comprising four hangers, and four mounts spaced about the inner surface of the shell.

6. A hardhat for supporting a suspension, the suspension having a horizontal band that is configured to at least partially encircle a user's head, the hardhat comprising:

a shell having an outer surface and an inner surface;

a hanger configured to be connected to said suspension for securing said suspension to the shell, the hanger further comprising:

a hook at a first lower end of the hanger;

a latching surface located towards a middle of the hanger;

a lever arm at a second upper end of the hanger;

a mount formed on the inner surface of the shell, the mount having a mount platform toward a first lower end thereof and a ledge surface at a second upper end thereof;

wherein the hanger is configured to securely engage the mount with the latching surface of the hanger being in frictional engagement with the ledge surface of the mount and the mount platform being in direct facing relation with a surface on the hook, thereby positionally securing the hanger to the shell, and further wherein the first lower end of the hanger is the lower end thereof when the suspension is secured to the shell and the shell is in an upright position.

7. The hardhat of claim 6, the hanger further comprising a support arm having a free portion for connecting the hanger to the suspension, the support arm being connected to the lever arm by a spring.

8. The hardhat of claim 6, wherein the latching surface is formed on a latching body that extends radially outwardly from the hanger when a suspension is secured within a hardhat, and a user can disengage the latching surface from the ledge surface by deflecting the second end of the hanger radially inwardly.

9. The hardhat of claim 6, wherein the ledge surface of the mount faces upwardly, and the latching surface of the hanger faces downwardly.

10. The hardhat of claim 6 comprising four hangers, and four mounts spaced about the inner surface of the shell.

11. A hardhat suspension assembly configured for being secured within a hardhat shell, the hardhat shell having a mount formed on an inner surface of the shell, the mount having a mount platform toward a first lower end of the mount and a ledge surface at a second upper end of the mount, the hardhat suspension comprising:

a suspension comprising a horizontal band that is configured to at least partially encircle a user's head;

a hanger connected to the suspension for securing the suspension to the shell, the hanger further comprising:

a hook at a first lower end of the hanger;

a latching surface located towards a middle of the hanger;

a lever arm at a second upper end of the hanger;

wherein the hanger is configured to securely engage the mount, with the latching surface of the hanger being in frictional engagement with the ledge surface of the mount and the mount platform being in direct facing relation with a surface on the hook, thereby positionally securing the hanger to the shell, and further wherein the first lower end of the hanger is the lower end thereof when the suspension is secured to the shell and the shell is in an upright position.

12. The hardhat suspension assembly of claim 11, the hanger further comprising a support arm having a free portion for connecting the hanger to the suspension, the support arm being connected to the lever arm by a spring.

13. The hardhat suspension assembly of claim 11, wherein the latching surface is formed on a latching body that extends radially outwardly from the hanger when the suspension is secured within a hardhat, and a user can disengage the latching surface from the ledge surface by deflecting the second end of the hanger radially inwardly.

14. The hardhat suspension assembly of claim 11 wherein the ledge surface of the mount faces upwardly, and the latching surface of the hanger faces downwardly.

15. The hardhat suspension assembly of claim 11 comprising four hangers and four mounts spaced about the inner surface of the shell.

* * * * *